US012778189B2

(12) United States Patent
Batista et al.

(10) Patent No.: US 12,778,189 B2
(45) Date of Patent: Nov. 3, 2026

(54) AEROSOL-GENERATING ARTICLE WITH A CAPSULE PORTION

(71) Applicant: Philip Morris Products S.A., Neuchatel (CH)

(72) Inventors: Rui Nuno Rodrigues Alves Batista, Morges (CH); Ricardo Cali, Mannheim (DE)

(73) Assignee: Philip Morris Products S.A., Neuchatel (CH)

( * ) Notice: Subject to any disclaimer, the term of this patent is extended or adjusted under 35 U.S.C. 154(b) by 468 days.

(21) Appl. No.: 18/253,114

(22) PCT Filed: Nov. 19, 2021

(86) PCT No.: PCT/EP2021/082254
§ 371 (c)(1),
(2) Date: May 16, 2023

(87) PCT Pub. No.: WO2022/112117
PCT Pub. Date: Jun. 2, 2022

(65) Prior Publication Data

US 2024/0000137 A1 Jan. 4, 2024

(30) Foreign Application Priority Data

Nov. 24, 2020 (EP) ..... 20209561

(51) Int. Cl.
*A24D 1/20* (2020.01)
*A24D 3/02* (2006.01)
*A24F 40/46* (2020.01)

(52) U.S. Cl.
CPC ..... *A24D 1/20* (2020.01); *A24D 3/0216* (2013.01); *A24F 40/46* (2020.01)

(58) Field of Classification Search
CPC ..... A24D 1/02; A24D 1/002; A24D 1/20; A24D 3/0216; A24D 3/048; A24D 3/061; A24B 15/282; A24B 15/283
See application file for complete search history.

(56) References Cited

U.S. PATENT DOCUMENTS

2007/0012327 A1* 1/2007 Karles ..... A24C 5/475 131/202
2007/0095357 A1 5/2007 Besso et al.
(Continued)

FOREIGN PATENT DOCUMENTS

CN 209883049 U 1/2020
CN 211020998 U 7/2020
(Continued)

OTHER PUBLICATIONS

Japanese Office Action issued Feb. 27, 2025, in Patent Application No. 2023-530886, (submitting English translation only), 9 pages.
(Continued)

*Primary Examiner* — Eric Yaary
(74) *Attorney, Agent, or Firm* — Oblon, McClelland, Maier & Neustadt, L.L.P.

(57) ABSTRACT

An aerosol-generating article is provided, including: a substrate portion containing an aerosol-forming substrate; and a capsule portion containing a carrier material, one or more breakable capsules being embedded in the carrier material, the one or more breakable capsules containing one or more active agents, at least parts of the one or more breakable capsules being arranged at an outer surface of the aerosol-generating article. An aerosol-generating system, including an aerosol-generating device including a cavity and a heating element, and the aerosol-generating article, is also provided.

17 Claims, 4 Drawing Sheets

(56) References Cited

U.S. PATENT DOCUMENTS

Figure 1A:
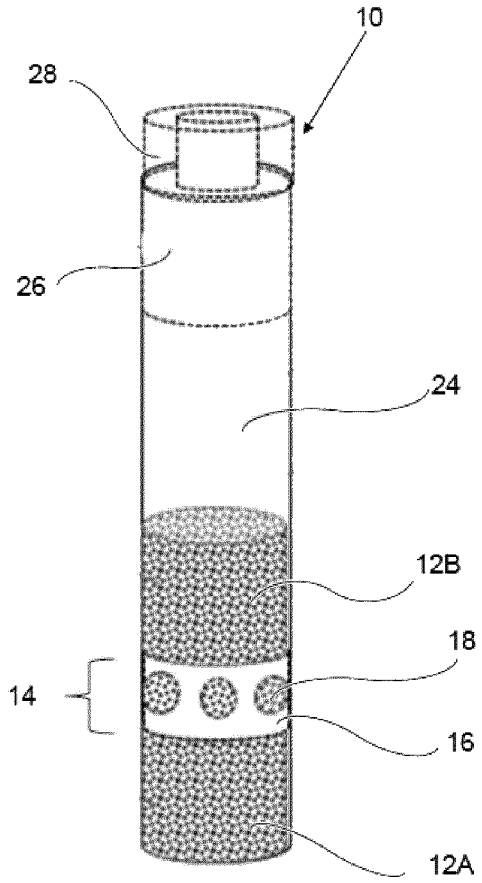

| | | | |
|---|---|---|---|
| 2008/0163877 | A1 | 7/2008 | Zhuang et al. |
| 2012/0006346 | A1 | 1/2012 | Inagaki |
| 2014/0202479 | A1 | 7/2014 | Nicholls et al. |
| 2015/0196052 | A1 | 7/2015 | Kobal |
| 2018/0310617 | A1 | 11/2018 | Ding |
| 2019/0254345 | A1 | 8/2019 | Hepworth et al. |

FOREIGN PATENT DOCUMENTS

| | | | |
|---|---|---|---|
| EP | 1 754 419 | A1 | 2/2007 |
| EP | 2 412 396 | A1 | 2/2012 |
| JP | 11-503912 | A | 4/1999 |
| JP | 2013-523108 | A | 6/2013 |
| JP | 2013-523112 | A | 6/2013 |
| JP | 2014-513538 | A | 6/2014 |
| JP | 2019-528717 | A | 10/2019 |
| KR | 10-2020-0013248 | A | 2/2020 |
| RU | 2 720 571 | C2 | 5/2020 |
| WO | WO 2007/060543 | A2 | 5/2007 |
| WO | WO 2008/084333 | A2 | 7/2008 |
| WO | WO-2014012840 | A2 * | 1/2014 ..... A24D 1/02 |
| WO | WO 2014/128973 | A1 | 8/2014 |
| WO | WO 2015/162731 | A1 | 10/2015 |
| WO | WO 2017/055456 | A1 | 4/2017 |
| WO | WO 2018/050612 | A1 | 3/2018 |
| WO | WO 2020/183171 | A1 | 9/2020 |

OTHER PUBLICATIONS

Japanese Office Action issued May 7, 2024 in Japanese Patent Application No. 2023-530886, 4 pages.

International Search Report and Written Opinion issued Feb. 4, 2022 in PCT/EP2021/082254, filed on Nov. 19, 2021, 11 pages.

International Preliminary Report on Patentability and Written Opinion issued May 30, 2023 in PCT/EP2021/082254, 8 pages.

European Office Action issued Jul. 11, 2024 in European Patent Application No. 21811070.8, 7 pages.

Russian Office Action Issued Nov. 1, 2023 in Application No. 2023113378/03(028362) (with English translation), 13 pages.

Office Action dated Mar. 31, 2026, issued in corresponding Chinese patent application No. 202180067493.9 (with English translation).

* cited by examiner

AEROSOL-GENERATING ARTICLE WITH A CAPSULE PORTION

The present invention relates to an aerosol-generating article. The present invention further relates to a system for generating an aerosol including the aerosol-generating article and an aerosol-generating device. The present invention further relates to the use of the aerosol-generating article for the formation of an aerosol.

Aerosol-generating devices are known which heat but which do not burn aerosol-forming substrates, such as tobacco, in aerosol-generating articles. Such devices heat the aerosol-forming substrates to a temperature sufficient to generate an aerosol for inhalation by the user. These aerosol-generating devices normally include an area for receiving the aerosol-forming substrates. These devices are typically portable, hand-held devices and are required to be compact.

The aerosol-forming articles normally contain an aerosol-forming substrate including an aerosol former and further substrate material such as tobacco, which includes volatile compounds for the formation of the aerosol. Some aerosol-forming articles also contain one or more capsules including additional ingredients. These additional ingredients may be unstable ingredients that may be decomposed or evaporate prior to use, when not housed in the capsule. Such a capsule is normally broken by the user prior to use, which is laborious and which may negatively affect the user experience. Other aerosol-generating devices include complicated mechanisms for breaking a capsule, often requiring additional user action.

It would be desirable to provide an aerosol-generating article including one or more capsules which can be broken with less or no additional user's actions required. It furthermore would be desirable to provide an aerosol-generating article with one or more capsules which can be broken without providing additional complicated breaking mechanisms in the aerosol-generating device. It would be desirable providing an aerosol-generating system comprising an aerosol-generating device including a cavity for receiving an aerosol-generating article, the system also comprising an aerosol-generating article with one or more capsules wherein the aerosol-generating article can easily be inserted into the cavity and wherein the capsules can be broken easily.

According to an embodiment of the present invention there is provided an aerosol-generating article that may comprise a substrate portion containing an aerosol-forming substrate. The aerosol-generating article may comprise a capsule portion containing a carrier material, wherein one or more breakable capsules may be embedded in the carrier material. The one or more breakable capsules may contain one or more active agents. At least parts of the one or more breakable capsules may be arranged at the outer surface of the aerosol-generating article.

According to an embodiment of the invention there is provided an aerosol-generating article comprising a substrate portion containing an aerosol-forming substrate. The aerosol-generating article furthermore contains a capsule portion containing a carrier material, wherein one or more breakable capsules are embedded in the carrier material. The one or more breakable capsules contain one or more active agents. At least parts of the one or more breakable capsules are arranged at the outer surface of the aerosol-generating article.

The one or more breakable capsules may be broken more easily compared to capsules which are located in the interior of the aerosol-generating article. One or more capsules arranged at the outer surface of the aerosol-generating article also may break easily when being received in the cavity of an aerosol-generating device. Upon breaking, the active agents may form part of an aerosol formed when heating the aerosol-forming substrate of the aerosol-generating article.

At least parts of the one or more breakable capsules may protrude from the outer surface of the aerosol-generating article. Capsules protruding from the outer surface of the aerosol-generating particle may be easy to break. The capsules may break when engaged with the aerosol-generating device. The capsules may have, however, a sufficient strength to not break before that, e.g. when processed or packaged.

The aerosol-generating article may have a cylindrical shape. The one or more breakable capsules may be arranged at the outer circumference of the article. Such an aerosol-generating article may be inserted into the cavity of an aerosol-generating device, wherein the breakable capsules located at the outer circumference of the article can easily be broken.

The aerosol-generating article may comprise a plurality of breakable capsules. The plurality of breakable capsules may be located around the outer circumference of the article. Such a configuration may ensure that a plurality of breakable capsules can easily be broken when inserting the aerosol-generating article into the cavity of an aerosol-generating device.

The capsule portion of the aerosol-generating article may comprise a central hollow tubular portion. This central hollow tubular portion may be stiffer than the carrier material in which the one or more breakable capsules may be embedded. The central hollow tubular portion may resist any pressure applied to the aerosol-generating article from the outside to the capsule portion, so that the one or more breakable capsules can be broken without the need to apply too much pressure to the capsule portion. The central hollow tubular portion may assist in breaking the one or more breakable capsules by not absorbing any pressure applied capsule portion from the outside.

The central hollow tubular portion may comprise one or more of plastic, paper and cardboard. Preferably, the central hollow tubular portion may be made from plastic or cardboard. These materials may be particularly well suited in order to assist any outside pressure applied to the capsule portion.

Another embodiment of the invention provides an aerosol-generating article which may comprise a substrate portion containing an aerosol-forming substrate. Furthermore, the aerosol-generating article may comprise a capsule portion containing a carrier material. One or more breakable capsules may be embedded in the carrier material, wherein the one or more breakable capsules may contain one or more active agents. The capsule portion furthermore may contain at least one stiff element, wherein the stiff element may be stiffer than the carrier material. The at least one stiff element may be configured for breaking the breakable capsules upon application of a pressure to the capsule portion.

A further embodiment of the invention provides an aerosol-generating article which comprises a substrate portion containing an aerosol-forming substrate. The aerosol-generating article also comprise a capsule portion containing a carrier material. One or more breakable capsules are embedded in the carrier material, wherein the one or more breakable capsules contain one or more active agents. The capsule portion furthermore contains at least one stiff element, wherein the stiff element is stiffer than the carrier material.

The at least one stiff element is configured for breaking the breakable capsules upon application of a pressure to the capsule portion.

The at least one stiff element may assist in breaking the one or more breakable capsules by directing any pressure applied to the capsule portion to the breakable capsules. The at least one stiff element may be better suited to direct any pressure applied to the capsule portion to the breakable capsules then the carrier material in which the breakable capsules are embedded.

The at least one stiff element may be wedge-shaped. Such a wedge-shaped stiff element may be well suited for breaking the one or more breakable capsules.

The at least one stiff element may contain sharp edges for penetrating the one or more breakable capsules. The sharp edges may further ease the breaking of the breakable capsules. The sharp edges may be configured pointed to improve breaking efficiency.

The at least one stiff element containing sharp edges may comprise one or more of plastic, metal or carbon. These materials can provide the sharp edges for breaking the one or more breakable capsules.

A plurality of stiff elements may be present in the capsule portion, wherein one breakable capsule may be concentrically surrounded by the plurality of stiff elements. Such a configuration of stiff elements together with the breakable capsule may particularly well direct any pressure applied to the capsule portion to the breakable capsule via the plurality of stiff elements. The breakable capsule may easily be broken when pressure is applied from different directions via different stiff elements.

The plurality of stiff elements may comprise at least two stiff elements. The two stiff elements may surround the breakable capsule, which may be centrally located in the capsule portion. Such a configuration is well suited in order to apply pressure to the capsule via the two stiff elements from different directions. The plurality of stiff elements may comprise at least three or at least four stiff elements. This may enable the application of pressure to the breakable capsule from different directions by applying pressure to the stiff elements.

One breakable capsule may be present in the capsule portion, wherein said capsule may be centrally arranged within the capsule portion. Such a centrally arranged capsule may be well positioned for receiving pressure from different stiff elements being arranged around the breakable capsule.

The at least one stiff element or the plurality of stiff elements may be in direct contact with the one or more breakable capsules. This may ease the breaking of the one or more breakable capsules.

The at least one stiff element or the plurality of stiff elements may be arranged at the outer surface of the aerosol-generating article. Thus, it may be possible to break the capsule by applying pressure to the stiff elements from outside of the aerosol-generating article, which then in turn will facilitate breaking the capsule.

The carrier material may be configured to resist pressure applied to the capsule portion. This may ensure that any pressure applied from the outside to the capsule portion is not absorbed by the carrier material, but leads to the breakage of the one or more breakable capsules.

The carrier material may be different to the aerosol-forming substrate included in the substrate portion of the aerosol-generating article. The carrier material may have a higher density than the aerosol-forming substrate in the substrate portion. The higher density of the carrier material also may reduce or prevent any absorption of the pressure applied to the capsule portion by the carrier material, so that the one or more breakable capsules can easily be broken.

The carrier material may comprise one or more of cellulose acetate fibre, paper, porous polymer and charcoal. The cellulose acetate fiber may be cellulose acetate tow. The porous polymer may be porous resins, such as a phenyl-formaldehyde resin.

The carrier material may have a compressive strength of between 20 to 60 Megapascal (MPa), preferably 29 to 53 Megapascal. The compressive strength can be determined according to DIN 5014 or ASTM D695.

The capsule portion of the aerosol-generating article may be wrapped with a capsule wrapper. The capsule wrapper may comprise a material which is impermeable for the one or more active agents contained in the one or more breakable capsules. The material may comprise impregnated paper, metallized paper or plastic. The capsule wrapper may comprise a paper impregnated with wax, plastic or other compounds rendering the wrapper impermeable for the active agents contained in the one or more breakable capsules. For example, the wrapper may be impregnated with aluminum stearate or ethylene vinyl acetate. The capsule wrapper may prevent any active agent contained in the one or more breakable capsules from being released out of the capsule portion of the aerosol-generating article into the aerosol-generating device. Thus, the capsule wrapper may reduce the amount of debris or contamination from the aerosol-generating article in the aerosol-generating device.

The one or more breakable capsules may be made of a frangible material. The frangible material may break when pressure is applied to the capsule portion.

The frangible material may comprise one or both of polysaccharide and polymers other than polysaccharides. Preferred polysaccharides may include pectin, alginate, carageenan, gums, modified cellulosics and agar. Preferred polymers other than polysaccharides may include proteins like gelatin or synthetic polymers such as derivatives of polyacrylates.

The capsules may have a spherical shape. The capsules may have the shape of a ball. The capsules may have a diameter of about 0.3 millimeters to about 6 millimeters, preferably from about 0.5 millimeters to about 3 millimeters. Capsules having such a size may easily be incorporated into the capsule portion of an aerosol-generating article.

The one or more breakable capsules may have burst strength of about 0.5 kilogram force to 3.0 kilogram force, preferably of about 1.3 to 2.7 kilogram force, most preferably of about 1.9 to about 2.5 kilogram force.

The aerosol-generating article may be shaped as a rod. Such a rod-shaped article may easily be received by the cavity of an aerosol-generating device. One or both of the capsule portion and the substrate portion of the aerosol-generating article may be shaped as a rod. Preferably both, the capsule portion and the substrate portion are shaped as a rod.

The one or more active agents contained in the one or more breakable capsules may be solid or liquid. The one or more active agents may comprise a gel. The one or more active agents may be volatile. Containing volatile active agents in the one or more breakable capsules may ensure that the volatile agents do not evaporate before the aerosol-generating article is used.

The one or more active agents may be prone to react with atmospheric components, such as oxygen. The one or more active agents may be highly volatile and diffuse without containment. Containing these sensitive active agents in the one or more breakable capsules may prevent any deterioration of the active agents before the aerosol-forming article is used.

The one or more active agents may comprise one or more of flavorants, nicotine and medications. For example, the one or more active agents may comprise flavorants oils, such as mint oil, menthol, nicotine oil or other flavorants.

In one embodiment of the aerosol-generating article the capsule portion may be adjacent to the substrate portion. This may ease the formation of aerosol containing components from both the substrate portion and the capsule portion.

The capsule portion may be located downstream of the substrate portion in the aerosol-generating article. This may facilitate incorporating any active agent released upon breaking the one or more breakable capsules into an aerosol formed from the aerosol-forming substrate of the substrate portion.

As used herein, the terms "upstream", and "downstream", are used to describe the relative positions of components, or portions of components, of the aerosol-generating article or the aerosol-generating device in relation to the direction in which air flows through the aerosol-generating article or aerosol-generating device during use thereof along the air flow path. Aerosol generating articles according to the invention comprise a proximal end through which, in use, an aerosol exits the device. The proximal end of the aerosol generating article may also be referred to as the mouth end or the downstream end. The mouth end is downstream of the distal end. The mouth end may comprise a mouthpiece. The distal end of the aerosol generating article may also be referred to as the upstream end. Components, or portions of components, of the aerosol generating article may be described as being upstream or downstream of one another based on their relative positions with respect to the airflow path through the aerosol generating article.

The aerosol-generating article may comprise at least two separate substrate portions, a first substrate portion and a second substrate portion both containing aerosol-forming substrate. The capsule portion may be located between the at least two separate substrate portions. Thus, the capsule portion may be located downstream of the first substrate portion, but upstream of the second substrate portion. Such a configuration of the substrate portions and the capsule portion may allow easy distribution of the one or more active agents into both substrate portions.

The aerosol-forming substrate of the substrate portion may comprise a plug of formed aerosol-forming substrate. The plug may be a pressed or molded substrate portion containing the aerosol-forming substrate or it may be a pre-packaged substrate portion including a wrapper, such as paper being wrapped around the aerosol-forming substrate. The aerosol-forming substrate may also comprise a gel. The aerosol-forming substrate may comprise a non-volatile carrier material onto which volatile one or both of aerosol-formers and one or more active agents which can form part of the aerosol. Examples of non-volatile carrier material may be paper or cotton. The aerosol-forming substrate is a substrate capable of releasing volatile compounds that can form an aerosol. The volatile compounds may be released by heating the aerosol-forming substrate. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may comprise homogenized tobacco. The aerosol-forming substrate may alternatively comprise a non-tobacco-containing material. The aerosol-forming substrate may comprise homogenised plant-based material.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The aerosol-former may be propylene glycol. The aerosol former may comprise both glycerine and propylene glycol.

The aerosol-generating article may comprise a hollow tubular article portion. The hollow tubular article portion may have a tubular empty core structure. The hollow tubular article portion may be for example a hollow acetate tube (HAT), a fine hollow acetate tube (FHAT) or a plug of tow wrapped around a central cardboard tube, or a tube formed of cardboard all of which structures being known from manufacture of filter elements. The hollow tubular article portion may be located downstream of the capsule portion of the aerosol-generating article. The hollow tubular article portion may serve to cool down the aerosol generated from the substrate portion and the capsule portion of the aerosol-generating article.

If desired or required, for example to achieve a sufficiently high resistance to draw of the aerosol-generating article, an additional filter portion may be included in the aerosol-generating article. Preferably such additional filter portion may be included downstream of the substrate portion and the capsule portion. If the hollow tubular article portion is also included in the aerosol-generating article, the filter portion may be located downstream of the hollow tubular article portion. Preferably, such additional filter portion comprises a filtration material such as, for example, cellulose acetate.

The invention also provides an aerosol-generating system which may comprise an aerosol-generating device including a cavity and a heating element. The aerosol-generating device also may include an aerosol-generating article as described herein. The cavity of the aerosol-generating device may be configured to receive said aerosol-generating article.

Also provided is an aerosol-generating system which comprises an aerosol-generating device including a cavity and a heating element. The aerosol-generating system also comprises an aerosol-generating article as described herein. The cavity of the aerosol-generating device is configured to receive said aerosol-generating article.

The one or more breakable capsules located in the capsule portion of the aerosol-generating article may be broken when inserting the aerosol-generating article into the cavity of the aerosol-generating device. Upon heating of the aerosol-generating article with the heating element, an aerosol may be formed from the aerosol-forming substrate and the one or more active agents.

The aerosol-generating device of the aerosol-generating system may comprise a deformation member configured for exerting a pressure to said aerosol-generating article. The deformation member may be configured to exert a pressure to the capsule portion of the aerosol-generating article, thereby breaking the one or more breakable capsules.

The deformation member may facilitate the breaking of the one or more breakable capsules in the aerosol-generating article without the need for any further action by a user.

The heating element may comprise the deformation member.

The heating element may be an induction heating element, wherein the heating element comprises a susceptor configured for heating. The susceptor may comprise a thermally deformable element, wherein the thermally deformable element is arranged in the cavity of the aerosol-generating device. The thermally deformable element may be configured to thermally deform during the heating operation to contact and apply pressure to the aerosol-generating article received in the cavity during the heating operation.

By providing the susceptor comprising a thermally deformable element, the susceptor can deform during a heating operation. The deformation of the susceptor may be utilized. Particularly, the aerosol-generating article may be held by the susceptor due to the deformation of the susceptor during operation applying pressure to the aerosol-generating article. Thereby, loosening of the aerosol-generating article during a heating operation may be prevented. The pressure applied by the thermally deformable element may be applied to the capsule portion of the aerosol-generating article. The pressure may break the one or more breakable capsule located in the capsule portion, thereby releasing the one or more active agents contained in the breakable capsules. Further, the heating efficiency may be improved due to a closer contact between the susceptor and the aerosol-generating article. Employing a susceptor with such thermally deformable element may not require any further action by a user in order to break the one or more breakable capsules.

The thermally deformable element may be made from bimetal. By utilizing a bimetal, the thermally deformable element may deform when heated. The bimetal may be configured to convert a temperature change to a deformation of the bimetal. The bimetal may comprise two metals joined together. The two metals may have different coefficients of thermal expansion leading to the deformation during heating. The two metals of the bimetal may be arranged such that the deformation during heating happens in the direction of the aerosol generating article. The metal with the lower coefficient of thermal expansion may be placed closer to the aerosol generating article. In this way, the thermally deformable element comes closer to the aerosol-generating article during the heating operation.

The thermally deformable element may comprise a bimetal strip. The bimetal strip may be elongate. The longitudinal axis of the bimetal strip may be parallel to the longitudinal axis of the cavity. The bimetal strip may comprise two elongate metals joined together. The joining axis of the two metals may be parallel or along the longitudinal axis of the bimetal strip. The bimetal strip may have a rectangular cross-section. However, other cross-sections of the bimetal strip are possible such as a square, circular or elliptical cross-section.

The susceptor may be made from bimetal. In this case, the susceptor has a double functionality. The first functionality of the susceptor may be to be heated during a heating operation. The second functionality of the susceptor may be a deformation during heating. Particularly preferred, the susceptor may be the thermally deformable element.

The susceptor may comprise a first material and a second material. The first material may have a lower thermal coefficient of thermal expansion than the second material. The first material may be a first metal. The second material may be a second metal. The first material may be different from the second material. Particularly, the first metal may be different from the second metal.

The present invention also provides an aerosol-generating system with an aerosol-generating device as described in the co-pending EP patent application EP 20 209 516.2, which is incorporated in its entirety by reference.

A minimum diameter of the cavity of the aerosol-generating device may have a diameter smaller than the diameter of the aerosol-generating article. In particular, the minimum diameter of the cavity may have a diameter smaller than the diameter of the capsule portion of the aerosol-generating article. This may ensure that due to the smaller diameter of the cavity, additional pressure is exerted on the aerosol-generating article, in particular its capsule portion. This additional pressure may aid in breaking the one or more breakable capsules.

The cavity of the aerosol-generating device may comprise inner walls. In embodiments where the minimum diameter of the cavity is smaller than the diameter of the aerosol-generating article, the inner walls of the cavity may exert additional pressure on the aerosol-generating article due to the smaller diameter of the inner walls, in particular its capsule portion.

The cavity of the aerosol-generating device of the aerosol-generating system may comprise a diameter which is tapered towards the interior of the aerosol-generating device. This may ensure that in particular the upstream portions of the aerosol-generating article, such as the capsule portion are subjected to additional pressure, when inserting the aerosol-generating article into the cavity.

The cavity of the aerosol-generating device may have an open end into which the aerosol-generating article is inserted. The open end may be a proximal end. The cavity may have a closed end opposite the open end. The closed end may be the base of the cavity. The closed end may be closed except for the provision of air apertures arranged in the base. The base of the cavity may be flat. The base of the cavity may be circular. The base of the cavity may be arranged upstream of the cavity. The open end may be arranged downstream of the cavity. The cavity may have an elongate extension. The cavity may have a longitudinal central axis. A longitudinal direction may be the direction extending between the open and closed ends along the longitudinal central axis. The longitudinal central axis of the cavity may be parallel to the longitudinal axis of the aerosol-generating device.

The cavity may be configured as a heating chamber. The cavity may have a cylindrical shape. The cavity may have a hollow cylindrical shape. The cavity may have a shape corresponding to the shape of the aerosol-generating article to be received in the cavity. The cavity may have a circular cross-section. The cavity may have an elliptical or rectangular cross-section. The cavity may have an inner diameter corresponding to the outer diameter of the aerosol-generating article.

An airflow channel may run through the cavity. Ambient air may be drawn into the aerosol-generating device, into the cavity and towards the user through the airflow channel. Downstream of the cavity, a mouthpiece may be arranged or a user may directly draw on the aerosol-generating article. The airflow channel may extend through the mouthpiece.

The aerosol-generating device of the present invention is arranged to heat the aerosol-forming substrate to a temperature below a combustion temperature of the aerosol-forming substrate, but at or above a temperature at which one or more volatile compounds of the aerosol-forming substrate are released to form an inhalable aerosol for inhalation by a user.

The aerosol-generating device may comprise electric circuitry. The electric circuitry may comprise a microprocessor, which may be a programmable microprocessor. The microprocessor may be part of a controller. The electric circuitry may comprise further electronic components. The electric circuitry may be configured to regulate a supply of power to the heating element, particularly to the induction coil. Power may be supplied to the heating element continuously following activation of the aerosol-generating device or may be supplied intermittently, such as on a puff-by-puff basis. The power may be supplied to the heating element in the form of pulses of electrical current. The electric circuitry may be configured to monitor the electrical resistance of the heating element, and preferably to control the supply of power to the heating element dependent on the electrical resistance of the heating element.

The aerosol-generating device may comprise a power supply, typically a battery, within a main body of the aerosol-generating device. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery. As an alternative, the power supply may be another form of charge storage device such as a capacitor. The power supply may require recharging and may have a capacity that enables to store enough energy for one or more usage experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heating element.

The invention also provides the use of an aerosol-generating article as described herein for the formation of an aerosol in an aerosol-generating device. The aerosol-generating device may include a cavity configured for receiving the aerosol-generating article. The carrier material of the aerosol-generating article in the capsule section may resist a pressure applied to the capsule portion upon one or both of insertion of the aerosol-forming article into the aerosol-generating device or heating of the aerosol-forming article.

Below, there is provided a non-exhaustive list of non-limiting examples. Any one or more of the features of these examples may be combined with any one or more features of another example, embodiment, or aspect described herein.

Example A: Aerosol-generating article comprising:

- a substrate portion containing an aerosol-forming substrate and
- a capsule portion containing a carrier material, one or more breakable capsules being embedded in the carrier material, the one or more breakable capsules containing one or more active agents, wherein at least parts of the one or more breakable capsules are arranged at the outer surface of the aerosol-generating article.

Example B: The aerosol-generating article according to Example A, wherein at least parts of the one or more breakable capsules protrude from the outer surface of the aerosol-generating article.

Example C: The aerosol-generating article according to any one of the preceding examples, wherein the aerosol-generating article has a cylindrical shape, the one or more breakable capsules being arranged at the outer circumference of the article.

Example D: The aerosol-generating article according to Example C, comprising a plurality of breakable capsules, wherein the plurality of capsules are located around the outer circumference of the article.

Example E: The aerosol-generating article according to any one of the preceding examples, wherein the capsule portion comprises a central hollow tubular portion, preferably wherein the central hollow tubular portion is stiffer than the carrier material.

Example F: Aerosol-generating article comprising:

- a substrate portion containing an aerosol-forming substrate and
- a capsule portion containing a carrier material, one or more breakable capsules being embedded in the carrier material, the one or more breakable capsules containing one or more active agents, wherein the capsule portion furthermore contains at least one stiff element, the stiff element being stiffer than the carrier material, the at least one stiff element configured for breaking the breakable capsules upon application of a pressure to the capsule portion.

Example G: The aerosol-generating article according to Example F, wherein the at least one stiff element is wedge shaped.

Example H: The aerosol-generating article according to any one of the Examples F or G, wherein the at least one stiff element contains sharp edges for penetrating the one or more breakable capsules.

Example I: The aerosol-generating article according to any one of the Examples F to H, wherein a plurality of stiff elements is present in the capsule portion and wherein one breakable capsule is concentrically surrounded by the plurality of stiff elements.

Example J: The aerosol-generating article according to any one of the Examples F to I, wherein one breakable capsule is present in the capsule portion, said capsule is centrally arranged within the capsule portion.

Example K: The aerosol-generating article according to any one of the Examples F to J, wherein the at least one stiff element is in direct contact with the one or more breakable capsules.

Example L: The aerosol-generating article according to any one of the Examples F to K, wherein the at least one stiff element is arranged at the outer surface of the aerosol-generating article.

Example M: The aerosol-generating article according to any one of the Examples F to L, wherein the at least one stiff element is one or more of plastic, metal or carbon.

Example N: Aerosol-generating article according to any one of the preceding examples, wherein the carrier material is configured to resist pressure applied to the capsule portion.

Example O: The aerosol-generating article according to any one of the preceding examples, wherein the carrier material has a higher density than the aerosol-forming substrate.

Example P: The aerosol-generating article according to any one of the preceding examples, wherein the capsule portion is wrapped with a capsule wrapper, the capsule wrapper comprising a material which is impermeable for the one or more active agents, preferably wherein the material comprises a plastic.

Example Q: The aerosol-generating article according to any one of the preceding examples, wherein the carrier material is selected from a group consisting of cellulose acetate, paper, porous polymer and charcoal or mixtures thereof.

Example R: The aerosol-generating article according to any one of the preceding examples, wherein the one or more breakable capsules are made of a frangible material, preferably wherein the capsules comprise polysaccharide and polymers or a mixture thereof.

Example S: The aerosol-generating article according to any one of the preceding examples, wherein the article is shaped as a rod.

Example T: The aerosol-generating article according to any one of the preceding examples, wherein the one or more active agents are volatile, preferably wherein the one or more active agents are in liquid form.

Example U: The aerosol-generating article according to any one of the preceding examples, wherein the capsule portion is adjacent to the substrate portion.

Example V: The aerosol-generating article according to any one of the preceding examples, comprising at least two separate substrate portions containing aerosol-forming substrate, wherein the capsule portion is located between the at least two separate substrate portions.

Example W: The aerosol-generating article according to any one of the preceding examples, wherein the substrate portion comprises an aerosol-former, preferably wherein the aerosol-former is selected from polyhydric alcohols, esters of polyhydric alcohols, or aliphatic esters of mono-, di- or polycarboxylic acids or a combination thereof.

Example X: The aerosol-generating article according to any one of the preceding examples, wherein the substrate portion comprises one or both of tobacco or a non-tobacco-containing material.

Example Y: The aerosol-generating article according to any one of the preceding examples, the article furthermore comprising a hollow tubular article portion.

Example Z: The aerosol-generating article according to any one of the preceding examples, the article furthermore comprising a filter portion.

Example AA: Aerosol-generating system, comprising an aerosol-generating device including a cavity and a heating element, and an aerosol-generating article according to any one of the preceding examples, wherein the cavity is configured to receive said aerosol-generating article.

Example AB: The aerosol-generating system according to Example AA, wherein the aerosol-generating device comprises a deformation member configured for exerting a pressure to said aerosol-generating article, in particular to the capsule portion.

Example AC: The aerosol-generating system according to the Examples AA or AB, wherein the heating element comprises the deformation member, preferably wherein the deformation member is an a thermally deformable susceptor element of an induction heating element.

Example AD: The system for generating an aerosol according to Example AA, wherein the deformation member is a thermally deformable susceptor element, the susceptor element is configured to exert a pressure to said one or more breakable capsules upon heating.

Example AE: The system for generating an aerosol according to Example AA, wherein a minimum inner diameter of the cavity has a diameter smaller than the diameter of said aerosol-generating article.

Example AF: The aerosol-generating system according to the Examples AA or AE, wherein the cavity comprises a diameter which is tapered towards the interior of the aerosol-generating device.

Example AG: Use of the aerosol-generating article according to anyone of the Examples A to Z, for the formation of an aerosol in an aerosol-generating device, the aerosol-generating device including a cavity configured for receiving the aerosol-generating article, wherein the carrier material resists a pressure applied to the capsule portion upon one or both of insertion of the aerosol-forming article into the aerosol-generating device or heating of the aerosol-forming article.

Features described in relation to one embodiment may equally be applied to other embodiments of the invention.

Figure 1B:
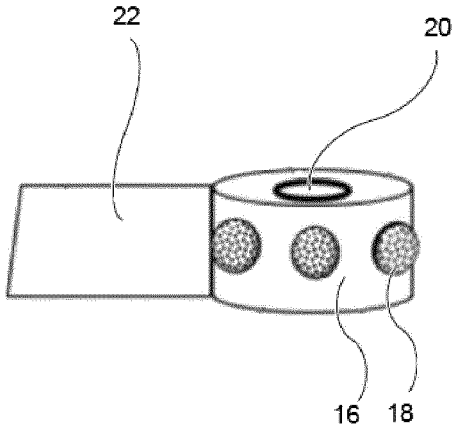
Figure 2A:
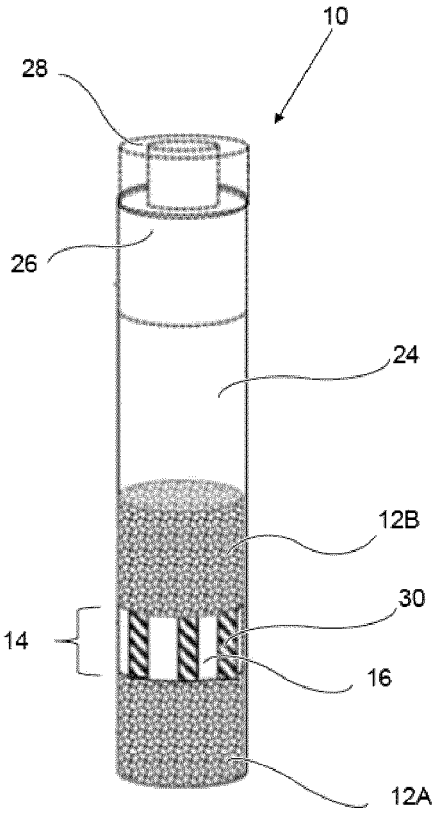
Figure 2B:
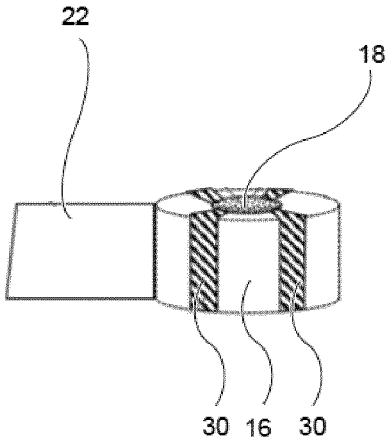
Figure 3:
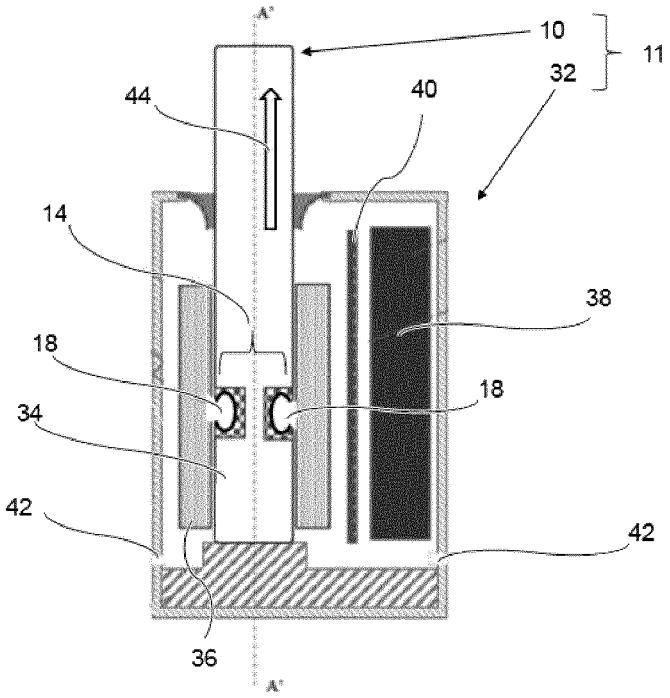
Figure 4:
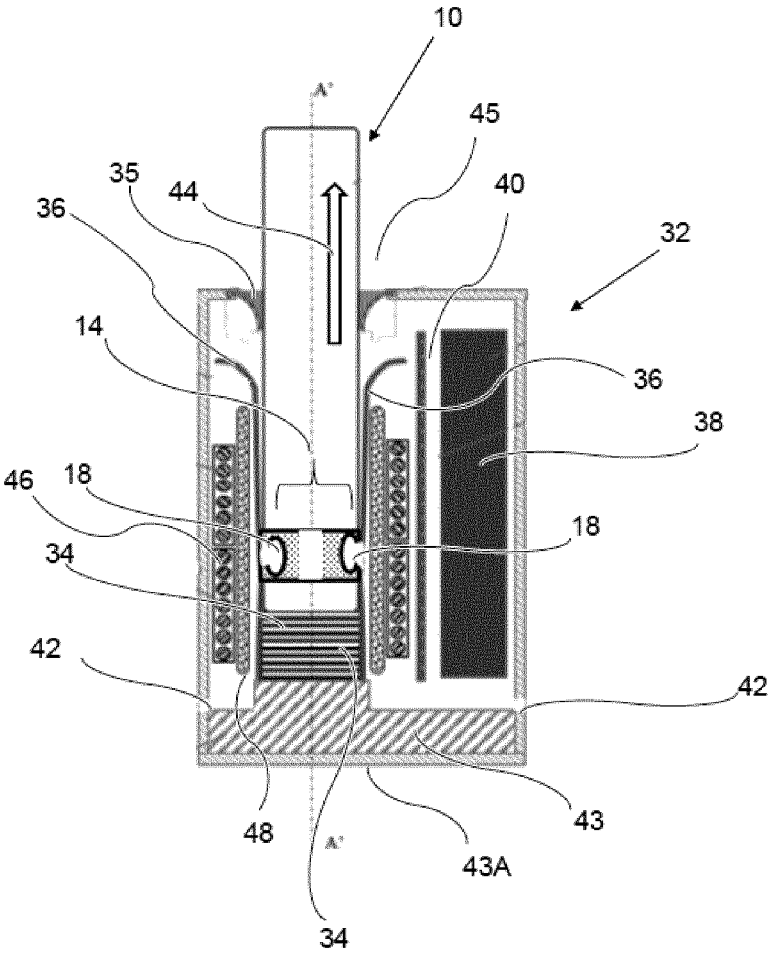

The invention will be further described, by way of example only, with reference to the accompanying drawings in which:

FIG. 1A and FIG. 1B show a schematic perspective view of an aerosol-generating article 10 and a close-up view of its capsule portion 14;

FIG. 2A and FIG. 2B show a schematic perspective view of an aerosol-generating article 10 with stiff elements 30 and a close-up view of its capsule portion 14;

FIG. 3 depicts a schematic cross-sectional view of an aerosol-generating system 11 with the aerosol-generating article 10 received in the cavity 34 of the aerosol generating device 32, showing the broken capsules;

FIG. 4 depicts a schematic cross-sectional view of an aerosol-generating system 11 with the aerosol-generating article 10 received in the cavity 34 of the aerosol generating device 32, wherein inductive heating is used, wherein the susceptor comprises a thermally deformable element.

In the following the same elements are marked with the same reference numerals throughout all the figures.

FIG. 1A shows a schematic perspective view of one embodiment of an aerosol-generating article 10. The aerosol-generating article contains a capsule portion 14, which includes breakable capsules 18 which are embedded in a carrier material 16. The capsule portion 14 is adjacent to a first substrate portion 12A and to a second substrate portion 12B. The first and second substrate portions include an aerosol-forming substrate and optionally also aerosol-former. A hollow tubular article portion 24 is located downstream of the second substrate portion 12B, which serves to cool down the aerosol generated in both substrate portions and in the capsule portion. A filter portion 26 is located further downstream of the hollow tubular article portion. The downstream end of the aerosol-generating article 10 is formed by a connect portion 28, which can serve to connect the aerosol-generating article to a mouthpiece (mouthpiece not shown). FIG. 1B is a close-up view of the capsule portion 14 of the aerosol-generating article 10 of FIG. 1A. This close-up view clearly shows that a plurality of the capsules 18 is located around the outer circumference of the capsule portion 14. The plurality of the capsules 18 protrude from the outer surface of the aerosol-generating article, in particular the capsule portion, and therefore can easily be exposed to pressure from the outside sufficient to break one or more of the capsules. A central hollow tubular portion 20, made of a stiff material is present, which serves to resist any pressure on the capsule portion from the outside, so that the capsules can be broken by sufficient external force. The capsule portion 14 is wrapped in a capsule wrapper 22, the capsule wrapper comprising a material which is impermeable for the one or more active agents released upon the breakage of the capsules. The capsule wrapper 22 may for example be made from anti-staining metals or lacquers. As an alternative to the capsule wrapper 22 being wrapped around the capsules, a single wrapper may be provided wrapped around the capsule portion and covering the capsules. This alternative wrapper may not necessarily directly contact the capsules. The capsule wrapper 22 therefore can prevent contamination or spill-over from the capsule portion 14 into an aerosol-generating device used together with the aerosol-generating article 10.

FIG. 2A shows a schematic perspective view of another embodiment of an aerosol-generating article 10. The aerosol-generating article 10 shown in this figure contains substantially the same elements as the aerosol-generating article 10 of FIG. 1A, except for some differences in the configuration of the capsule portion 14. In FIG. 2A the capsule portion 30 comprises the carrier material 16 and additionally stiff elements 30. The stiff elements 30 are wedge-shaped elements, which can be made of plastic or metal and which may contain sharp edges. At least parts of the stiff elements 30 are located at the outer surface of the capsule portion 14, so that pressure can easily be applied to the stiff elements 30 from the outside. As shown in the close-up view of the capsule portion 14 in FIG. 2B, four stiff elements 30 are arranged concentrically around a breakable capsule 18, which is located centrally within the capsule portion 14. Similarly to the capsule portion 14 of the generating article 10 of FIG. 1A, the capsule portion 14 of the aerosol-generating article in FIG. 2A also includes a capsule wrapper 22, which prevents any spill-over of the one or more active agents which are released when the capsule 18 is broken. The stiff elements 30 are in direct contact with the centrally located breakable capsule 18 and therefore can easily transmit any pressure applied from the outside to the breakable capsule.

FIG. 3 shows a cross-sectional view of an aerosol-generating system 11. The aerosol-generating system comprises an aerosol-generating device 32 and an aerosol-generating article 10. The aerosol-generating device comprises a heating element 36. The aerosol-generating article 10 is inserted in the cavity 34 of the aerosol-generating device 32. The breakable capsules 18 protrude from the outer surface of the capsule portion 14 and therefore are being broken when the aerosol-generating article 10 is inserted into the cavity 34 of the aerosol-generating device 32. The capsules 18 therefore can reliably be broken without any additional user's action required. The user only needs to put the aerosol-generating article 10 into the aerosol-generating device 32 but not further action is needed for the breading of the capsules 18. The aerosol-generating device 32 furthermore contains electric circuitry 40 controlling the heating element 36, which is a resistive heating element. The electric circuitry 40 and the resistive heating element 36 are powered by the power supply 38. Air inlets 42 are present in the aerosol-generating device 32 and an air-flow path 44 as depicted by the arrow is present in the aerosol-generating system 11. A user drawing on the aerosol-generating article 10 can inhale an aerosol created from the substrate portion (not shown in FIG. 3) and from the capsule portion 14 of the aerosol-generating article.

FIG. 4 shows a cross-sectional view of another embodiment of an aerosol-generating system 11. The heating element 36 comprises susceptors. Each susceptor 36 has an elongate shape. Each susceptor 36 is made of a thermally deformable element in the form of a bimetallic strip. The bimetallic strip comprises a first material and a second material. The coefficients of thermal expansion of the two materials are different. The material with the lower coefficient of thermal expansion is arranged towards the inside of the cavity 34 formed by the susceptor 12. The cavity 34 is formed as a hollow tubular arrangement.

The aerosol-generating article 10 is configured to be received in the cavity 34. The aerosol-generating article 10 can be inserted into the cavity 34. When the aerosol-generating article 10 is inserted into the cavity 34, the heating element 36 surrounds a portion of the aerosol-generating article 10, also including the capsule portion 14. The portion of the aerosol-generating article 10 surrounded by the heating element 36 can be heated by means of the heating element 36.

The portion of the aerosol-generating article 10 surrounded by the heating element 10 is preferably configured as a substrate portion of the aerosol-generating article 16 comprising aerosol-forming substrate (not shown in FIG. 4) and a capsule portion 14 including breakable capsules 18.

During a heating operation, the heating element 36 is deformed. The deformation is facilitated by the bimetallic strip being heated. The heating of the bimetallic strip results in a deformation of the bimetallic strip. The susceptor 36 is arranged such that the deformation is in the direction of the inside of the cavity 34. In this way, the aerosol-generating article 10 is securely held within the cavity 34 during a heating operation and additionally the breakable capsules 18 are broken due to the deformation of the susceptor 36 in the direction of the inside of the cavity 34 which exerts a pressure on the capsules. Before and after the heating operation, the aerosol-generating article 10 can be easily inserted into the cavity 34 and removed from the cavity.

To enable insertion and removal of the aerosol-generating article 10, the inner diameter of the heating element 36 is slightly larger than the outer diameter of the aerosol-generating article 10, when the heating element 36 is not operated. During operation of the heating element 36, the heating element is deformed and the inner diameter of the heating element 36 is reduced. The reduced inner diameter of the heating element 10 is slightly smaller than the outer diameter of the aerosol-generating article 10. Consequently, the heating element 36 is pressed against the aerosol-generating article 10 during the heating operation and the breakable capsules 18 are broken by the pressure of the heating element. The aerosol-generating article 10 is consequently securely held and heating efficiency is increased.

FIG. 4 further shows a power supply in the form of a battery 38 for powering the heating element 36. The supply of electrical energy from the battery 36 to the heating element 36 is controlled by control circuitry 40.

The aerosol-generating device or the heating element 36 comprises an induction coil 46. An alternating current is supplied to the induction coil 46 for generating an alternating magnetic field. The susceptor 36 is heated when subjected to this alternating magnetic field. In the embodiment shown in FIG. 4, two induction coils 46 are provided that are separated by a separator 48. The two induction coils 46 create two separate heating zones that are provided along the longitudinal axis A of the cavity 34.

Air inlets 42 are provided to enable flow of ambient air into the cavity 34 for aerosol generation. The air inlets 42 are arranged adjacent a base 43 of the cavity 34 to enable airflow into the cavity 34 through or adjacent to the base 43. The base 43 may comprise one or more apertures for allowing airflow through the base 43.

The aerosol-generating device comprises a distal end 43A and a proximal end 45. The opening of the cavity 34 is arranged in the proximal end 45 of the aerosol-generating device. At the opening of the cavity 34, a sealing ring 35 is provided. The sealing ring 35 is flexible. The sealing ring 35 has a funnel shape. The sealing ring 35 enables insertion of the aerosol-generating article 10. The sealing ring 35 seals the cavity 34, when the aerosol-generating article 10 is inserted into the cavity 34.

The invention claimed is:

1. An aerosol-generating article, comprising:

a substrate portion containing an aerosol-forming substrate; and a capsule portion containing a carrier material, one or more breakable capsules being embedded in the carrier material, the one or more breakable capsules containing one or more active agents, wherein at least parts of the one or more breakable capsules are arranged at an outer surface of the aerosol-generating article.

2. The aerosol-generating article according to claim 1, wherein the at least parts of the one or more breakable capsules protrude from the outer surface of the aerosol-generating article.

3. The aerosol-generating article according to claim 1, wherein the aerosol-generating article has a cylindrical shape, the one or more breakable capsules being arranged at an outer circumference of the article.

4. The aerosol-generating article according to claim 3, further comprising a plurality of breakable capsules located around the outer circumference of the article.

5. The aerosol-generating article according to claim 1, wherein the capsule portion comprises a central hollow tubular portion.

6. The aerosol-generating article according to claim 1, wherein the carrier material is configured to resist pressure applied to the capsule portion.

7. The aerosol-generating article according to claim 1, wherein the capsule portion is wrapped with a capsule wrapper, the capsule wrapper comprising a material that is impermeable for the one or more active agents.

8. An aerosol-generating system, comprising:

an aerosol-generating device including a cavity and a heating element; and an aerosol-generating article according to claim 1, wherein the cavity is configured to receive the aerosol-generating article.

9. The aerosol-generating system according to claim 8, wherein the aerosol-generating device comprises a deformation member configured to exert a pressure to the aerosol-generating article.

10. The aerosol-generating system according to claim 9, wherein the deformation member is further configured to exert a pressure to the capsule portion of the aerosol-generating article.

11. The aerosol-generating system according to claim 9, wherein the heating element comprises the deformation member.

12. The aerosol-generating system according to claim 8, wherein a minimum inner diameter of the cavity has a diameter smaller than a diameter of the aerosol-generating article.

13. The aerosol-generating system according to claim 8, wherein the cavity comprises a diameter that is tapered towards an interior of the aerosol-generating device.

14. The aerosol-generating article according to claim 1, wherein the carrier material has a higher density than the aerosol-forming substrate of the substrate portion.

15. The aerosol-generating article according to claim 1, wherein the carrier material comprises one or more of cellulose acetate fibre, porous polymer, and charcoal.

16. The aerosol-generating article according to claim 7, wherein the capsule wrapper is wrapped around the breakable capsules for preventing contamination or spill-over from the capsule portion.

17. The aerosol-generating article according to claim 16, wherein the material comprises impregnated paper, metallized paper, or plastic.

* * * * *